252/101

United States Patent [19]

Tomaszewski

[11] 4,244,833

[45] Jan. 13, 1981

[54] COMPOSITION AND PROCESS FOR CHEMICALLY STRIPPING METALLIC DEPOSITS

[75] Inventor: Lillie C. Tomaszewski, Dearborn, Mich.

[73] Assignee: Oxy Metal Industries Corporation, Warren, Mich.

[21] Appl. No.: 94,617

[22] Filed: Nov. 15, 1979

[51] Int. Cl.[3] ..... C23G 1/04; C23G 1/08

[52] U.S. Cl. ..... 252/101; 252/79.2; 252/142; 134/3; 134/41; 156/664; 156/666

[58] Field of Search ..... 252/142, 101, 79.2; 156/18, 20; 134/3, 41

[56] References Cited

U.S. PATENT DOCUMENTS

| | | | |
|---|---|---|---|
| 3,015,630 | 1/1962 | Thompson et al. | 252/101 |
| 3,836,473 | 9/1974 | Kay et al. | 252/79.2 |
| 3,856,694 | 12/1974 | Becking | 252/101 |
| 4,108,680 | 8/1978 | Barr, Jr. | 134/41 X |

*Primary Examiner*—Mayer Weinblatt

*Attorney, Agent, or Firm*—Richard P. Mueller

[57] ABSTRACT

An improved process and composition for chemically stripping metallic deposits from a substrate, and particularly, from the contact tips of electroplating racks and like apparatus to maintain proper operating efficiency thereof. The improved composition and method employs an aqueous acidic solution containing nitric acid, chloride ions and manganous ions present in an amount sufficient to accelerate the initiation of and the rate of stripping of the metallic deposits. The method and composition are applicable for chemically stripping a variety of metallic deposits at stripping rates substantially higher than those heretofore attainable with prior art compositions and techniques.

26 Claims, No Drawings

COMPOSITION AND PROCESS FOR CHEMICALLY STRIPPING METALLIC DEPOSITS

BACKGROUND OF THE INVENTION

The present invention is broadly applicable for stripping unwanted metallic deposits from chemically resistant substrates and more particularly, for chemically removing unwanted metal plating deposits from the contact tips of electroplating work racks and the like.

It is conventional practice in the field of electroplating, to support work pieces to be plated on a work rack comprised of a chemically resistant metal such as titanium or stainless steel or a steel work rack provided with a protective coating such as a plastisol coating thereover. Electrification of the work pieces while suspended in a electrolyte is achieved by stainless steel or platinumized titanium contact tips on the rack disposed in electrical contact with the work pieces. During the electroplating operation, an unwanted deposit of the metal being plated builds up on the contact tips interfering with the efficiency and consistency of the electroplating operation. Accordingly, it is common practice to subject such plating racks to mechanical or chemical cleaning treatments to remove the unwanted accumulation of deposits from the contact tips.

A variety of mechanical and chemical techniques have heretofore been used or proposed for removing unwanted deposits from contact tips of electroplating racks to maintain optimum operating efficiency. Typical of such prior art techniques are those disclosed in U.S. Pat. Nos. 3,015,630; 3,104,167; 3,367,874; 3,399,143 and 3,856,694. While such prior art techniques and compositions as disclosed in the aforementioned patents have been satisfactory in removing certain metallic deposits, a continuing problem associated with such prior art techniques has been the relatively low rate at which the metallic deposits are stripped, the comparatively low capacity of the stripping composition for the metals stripped necessitating frequent replenishment, the selectivity of the specific metals which can be satisfactorily stripped and the inability to strip other metals necessitating alternative stripping compositions and the waste treatment facilities required for treating such stripping compositions in order that they can harmlessly be discharged to waste.

The present invention overcomes many of the problems and disadvantages associated with prior art techniques and compositions by providing a stripping composition and method employing the composition which has increased capacity for the dissolved metal ions, which initiates the stripping action more quickly and further provides for an increase in the rate at which the deposits are stripped, which is applicable for stripping a broader range of metallic deposits including metal alloys such as nickel-iron alloys as well as composite multi-layered deposits, and which required comparatively simple waste treatment facilities for treatment prior to discharge to waste.

SUMMARY OF THE INVENTION

The benefits and advantages of the present invention are achieved in accordance with the composition aspects of the present invention, by a chemical stripping solution comprising an aqueous acidic solution containing as its essential ingredients, nitric acid, chloride ions and manganous ions which are present in an amount sufficient to accelerate the initiation of and the rate of stripping of a variety of metallic deposits. The concentration of nitric acid can range from about 15% up to about 65% by volume (235 to about 1050 g/l); the chloride ion concentration can range from as low as about 0.2 g/l up to saturation; while the manganous ion concentration is usually controlled in amounts of about 0.2 up to about 10 g/l.

The solution may also advantageously contain as optional constituents, controlled effective amounts of cupric ions, ferrous ions and nickel ions as well as combinations thereof to further enhance the stripping action of the stripping solution.

In accordance with the method aspects of the present invention, metallic deposits such as copper, bright nickel, sulfur-free nickel, nickel-iron alloys, nickel-phosphorous alloys, chromium, brass, tin, cadmium, zinc and rhodium can be effectively stripped by employing the foregoing stripping solution at temperatures ranging from about 60° F. to about 150° F. and the metallic deposit is maintained in contact with the solution for a period of time sufficient to effect the desired magnitude of stripping of the deposit.

Additional benefits and advantages of the present invention will become apparent upon a reading of the description of the preferred embodiments taken in conjunection with the specific examples provided.

DESCRIPTION OF THE PREFERRED EMBODIMENTS

The chemical stripping composition of the present invention comprises an aqueous solution containing a comparatively high concentration of nitric acid in combination with a controlled amount of chloride ions and a controlled effective amount of manganous ions to effect an acceleration of the initiation of the stripping action and to further increase the rate at which the metal deposit is removed. The aqueous acidic solution can broadly contain from about 15% up to about 65% by volume nitric acid, preferably from about 30% up to about 55% by volume nitric acid with amounts of about 50% nitric acid being particularly satisfactory. On a weight basis, the nitric acid concentration can broadly range from about 235 grams per liter (g/l) up to about 1050 g/l, preferably about 490 to about 900 g/l with concentrations of about 825 g/l being particularly satisfactory. The nitric acid constituent of the solution is conveniently introduced in the form of a relatively concentrated solution such as 42° Baumé which conventionally comprises about a 69% by weight aqueous solution of nitric acid.

The chloride ion is present in an amount of at least about 0.2 g/l up to concentrations approaching saturation of the solution. More usually, the concentration of the chloride ion is controlled within a range of about 0.5 up to about 10 g/l with concentrations of about 3 g/l being typical. The chloride ion can conveniently be introduced in the form of any alkali metal salt such as sodium chloride, for example, ammonium chloride, hydrochloric acid, or the like, as well as chloride salts of the other metal ions desirably present in the stripping solution including maganous chloride ($MnCl_2$), cupric chloride ($CuCl_2$) and ferrous chloride ($FeCl_2$), and nickel chloride ($NiCl_2$).

In addition to the nitric acid and chloride ion constituents, the aqueous stripping solution further contains as an essential constituent, manganous ions in controlled effective amounts which serve as an activator and reduce the time period following immersion in the chemical stripping composition before initiation of stripping occurs and also accelerates the rate of stripping of the metal deposit after initiation of the stripping reaction. Conventionally, manganous ion concentrations of about 0.2 up to about 10 g/l can be employed with amounts of about 1 to about 3 g/l being preferred. The manganous ion can be introduced into the solution in the form of any aqueous acid soluble salt such as manganous sulfate, manganous oxide, manganous halide salts including manganous chloride which simultaneously effects an introduction of the chloride ion.

In addition to the foregoing constituents, the aqueous stripping composition can also optionally and advantageously contain controlled effective amounts of additional metal ions including cupric ions, ferrous ions and nickel ions which further enhance the stripping reaction and the rate at which the metal deposit is removed. When stripping copper or nickel deposits as well as composite multi-layered plating deposits containing copper and nickel, the concentration of copper and nickel in the stripping solution will progressively increase during the use of the solution. The initial introduction of copper ions in the chemical stripping solution is advantageous in providing an artificial aging of the stripping solution rendering it more active initially than a fresh make-up solution devoid of any copper ions. The concentration of cupric ions in the bath may broadly range from about 0.2 up to about 10 g/l in the initial make-up solution and may further increase in concentration during the use of such solution in stripping copper deposits.

The use of ferrous ions in amounts broadly ranging from about 0.2 to about 10 g/l and preferably from about 0.5 to about 3 g/l also enhances the stripping action, particularly for stripping nickel-iron alloy deposits. The ferrous ion can be conveniently introduced in the form of any aqueous acid soluble salt including ferrous ammonium sulfate, ferrous halide salts including ferrous chloride, ferrous sulfate, or the like. Similarly, the presence of nickel ions in the stripping solution is also beneficial and may range in concentration from about 0.2 up to about 10 g/l, and preferably from about 0.5 g/l to about 3 g/l. The nickel ion similarly can be introduced in the form of any aqueous acid soluble salt including nickel halide salt, nickel sulfate, and the like.

In accordance with the process aspects of the present invention, the chemical stripping composition is contacted with the metal deposit to be removed at temperatures of from about 60° F. (room temperature) up to about 150° F., with temperatures of about 90° F. to about 130° F. being preferred. The contact time will vary depending upon the thickness and configuration of the metal deposit to be stripped and the desired magnitude of its removal from the substrate.

The aqueous stripping composition of the present invention has been found particularly suitable for stripping metal deposits including copper, bright nickel, brass, tin, cadmium, zinc, nickel-iron alloys, nickel-phosphorous alloys as well as composite multi-layered deposits such as chromium, nickel and copper; and rhodium, nickel and copper. The capacity and versatility of the stripping composition for effectively stripping the aforementioned metal deposits provides for distinct advantages over prior art formulations in which it was heretofore necessary to employ specially formulated compositions for the stripping of chromium and rhodium deposits, for example, in comparison to that required for stripping copper, nickel, and nickel-phosphorous alloys, for example. The stripping composition of the present invention further provides for an increased capacity of the metal ions stripped providing for a longer operating life before replenishment or adjustment of the stripping solution.

In order to further illustrate the composition and method of the present invention, the following specific examples are provided. It will be appreciated that the examples are provided for illustrative purposes and are not intended to be limiting of the scope of the present invention as herein disclosed and as set forth in the subjoined claims.

EXAMPLE 1

A chemical stripping bath is prepared according to prior art practice as a control containing 75% by volume of 42° Baume' nitric acid (about 712 g/l of 100% $HNO_3$) and 25% by volume water. The aqueous acid solution is heated to about 140° F. Test specimens comprising a type 316 stainless steel are prepared by pretreatment in a high chloride content nickel-chloride-boric acid strike solution and thereafter are electroplated with (1) a bright copper deposit, (2) a bright nickel deposit, (3) a semi-bright nickel deposit, (4) a nickel-iron alloy deposit comprised of about 75% by weight nickel, and (5) an nickel-phosphorous alloy deposit. The plated test specimens are immersed in the stripping formulation and the stripping rates are as follows:

| Stripping Rates: | Inches/Minute |
|---|---|
| (1) copper | 0.010 |
| (2) bright nickel | 0.0058 |
| (3) semi-bright nickel | 0.0000034 |
| (4) nickel-iron alloy | 0.000068 |
| (5) nickel-phosphorous alloy | 0.000408 |

EXAMPLE 2

A chemical stripping composition is prepared using 75% by volume of 42° Baume' nitric acid (about 712 g/l of 100% $HNO_3$) and 25% by volume water to which is added 1.5 g/l copper sulfate pentahydrate, 8 g/l sodium chloride and 1 g/l of manganous oxide. The solution is heated to a temperature of about 140° F. Test specimens comprising a type 316 stainless steel are prepared by pretreatment in a high chloride content nickel chloride-boric acid strike solution and thereafter are electroplated with (1) a bright nickel deposit, (2) a semi-bright nickel deposit and (3) a nickel-iron alloy deposit comprised of about 75% by weight nickel. The test specimens are immersed in the stripping formulation and stripping rates are as follows:

| Stripping Rates: | Inches/Minute |
|---|---|
| (1) bright nickel | 0.0151 |
| (2) semi-bright nickel | 0.00452 |
| (3) nickel-iron alloy | 0.0178 |

It will be apparent that the stripping rates of bright nickel, semi-bright nickel and nickel-iron alloy platings employing the stripping composition of Example 2 in accordance with the present invention are dramatically higher than those obtained for similar plate deposits employing the control solution of Example 1.

EXAMPLE 3

A chemical stripping composition is prepared employing 75% by volume of 42° Baume' nitric acid (about 712 g/l of 100% $HNO_3$) and 25% by volume water to which is added 6 g/l of sodium chloride, 1.7 g/l of cupric oxide, anhydrous; 2.5 g/l of manganous sulfate monohydrate, 4.5 g/l of ferrous sulfate monohydrate, and 5 g/l of nickel sulfate pentahydrate. Test specimens comprising a type 316 stainless steel are prepared in accordance with Examples 1 and 2 and are provided with the following metal platings: (1) bright copper, (2) bright nickel, (3) nickel-iron alloy, (4) nickel-phosphorous alloy, (5) brass, (6) tin, (7) cadmium, and (8) zinc. The test specimens are immersed in the stripping formulation at a temperature of about 140° F. and the stripping rates are as follows:

| Stripping Rates: | Inches/Minute |
|---|---|
| (1) bright copper | 0.01334 |
| (2) bright nickel | 0.014 |
| (3) nickel-iron alloy | 0.0178 |
| (4) nickel-phosphorous alloy | 0.00767 |
| (5) brass | 0.0178 |
| (6) tin | 0.005 |
| (7) cadmium | 0.035 |
| (8) zinc | 0.044 |

EXAMPLE 4

A chemical stripping composition is prepared employing 75% by volume of 42° Baume' nitric acid (about 712 g/l of 100% $HNO_3$) and 25% by volume water to which is added 15 g/l sodium chloride, 3.5 g/l of cupric sulfate pentahydrate, 5 g/l manganous sulfate monohydrate, 10 g/l ferrous sulfate monohydrate and 10 g/l nickel sulfate pentahydrate. The stripping composition of Example 4 is similar to that of Example 3 but wherein the copper, manganous, ferrous and nickel compounds are of higher concentration. Test specimens comprised of a type 316 stainless steel are prepared as previously described and are provided with (1) a bright nickel deposit and (2) a nickel-iron alloy deposit containing about 75% by weight nickel. The test specimens are immersed in the stripping composition at a temperature of about 140° F. and the stripping rates are as follows:

| Stripping Rates: | Inches/Minute |
|---|---|
| (1) bright nickel | 0.027 |
| (2) nickel-iron alloy | 0.028 |

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A composition for chemically stripping metallic deposits from a substrate comprising an aqueous acidic solution containing nitric acid, chloride ions and manganous ions present in an amount sufficient to accelerate the initiation and rate of stripping of the metallic deposit.

2. The composition as defined in claim 1 further containing ferrous ions.

3. The composition as defined in claim 1 further containing cupric ions.

4. The composition as defined in claim 1 further containing nickel ions.

5. The composition as defined in claim 1 containing about 235 to about 1050 g/l nitric acid.

6. The composition as defined in claim 1 containing about 490 to about 900 g/l nitric acid.

7. The composition as defined in claim 1 containing about 0.2 to about 10 g/l manganous ions.

8. The composition as defined in claim 1 containing about 0.5 to about 3 g/l manganous ions.

9. The composition as defined in claim 1 containing about 0.2 g/l chloride ions up to saturation.

10. The composition as defined in claim 1 containing about 0.5 to about 10 g/l chloride ions.

11. The composition as defined in claim 1 further containing about 0.2 to about 10 g/l cupric ions.

12. The composition as defined in claim 1 further containing about 0.2 to about 10 g/l ferrous ions.

13. The composition as defined in claim 1 further containing about 0.5 to about 3 g/l ferrous ions.

14. The composition as defined in claim 1 further containing about 0.2 to about 10 g/l nickel ions.

15. A method for chemically stripping metallic deposits from a substrate comprising the steps of contacting the metallic deposit to be stripped with an aqueous acidic solution at a temperature of about 60° F. containing nitric acid, chloride ions, and manganous ions present in an amount sufficient to accelerate the initiation and rate of stripping of the metallic deposit, and continuing the contact of said solution with said deposit for a period of time to effect the desired magnitude of stripping thereof.

16. The method as defined in claim 15 in which said nitric acid is present in an amount of about 235 to about 1050 g/l.

17. The method as defined in claim 15 in which said manganous ions are present in an amount of about 0.2 to about 10 g/l.

18. The method as defined in claim 15 in which said chloride ions are present in an amount of about 0.2 g/l up to saturation.

19. The method as defined in claim 15 in which said solution further contains cupric ions in an amount sufficient to enhance the stripping action of said solution.

20. The method as defined in claim 15 in which said solution further contains ferrous ions in an amount sufficient to enhance the stripping action of said solution.

21. The method as defined in claim 19 in which said cupric ions are present in an amount of about 0.2 to about 10 g/l.

22. The method as defined in claim 20 in which said ferrous ions are present in an amount of about 0.2 to about 10 g/l.

23. The method as defined in claim 13 in which said metallic deposit comprises a metal selected from the group consisting of copper, bright nickel, sulfur-free nickel, nickel-iron alloys, nickel-phosphorous alloys, chromium, brass, tin, cadmium, zinc and rhodium.

24. The method as defined in claim 15 in which said solution further contains nickel ions in an amount sufficient to enhance the stripping action of said solution.

25. The method as defined in claim 24 in which said nickel ions are present in an amount of about 0.2 to about 10 g/l.

26. The method as defined in claim 15 in which said solution contains about 235 to about 1050 g/l nitric acid, about 0.2 to about 10 g/l manganous ions, about 0.2 g/l up to saturation chloride ions, and further including a metal ion selected from the group consisting of cupric, ferrous, nickel and mixtures thereof present in an amount to enhance the stripping action of said solution.

* * * * *